US005794497A

United States Patent [19]

Anderson

[11] Patent Number: 5,794,497

[45] Date of Patent: Aug. 18, 1998

[54] DRIVER TOOL WITH ENERGY MAGNETIZER/DEMAGNETIZER ON TOOL HANDLE

[76] Inventor: Wayne Anderson, 65 Grove St., Newport, N.Y. 11768

[21] Appl. No.: 710,485

[22] Filed: Sep. 18, 1996

[51] Int. Cl.[6] ..... B25B 23/08

[52] U.S. Cl. ..... 81/451; 81/125

[58] Field of Search ..... 7/125; 81/125, 81/451

[56] References Cited

U.S. PATENT DOCUMENTS 3,884,282 5/1975 Dobrosielski ..... 81/451 X

*Primary Examiner*—James G. Smith

*Attorney, Agent, or Firm*—Lackenbach Siegel Marzullo Aronson & Greenspan, PC

[57] ABSTRACT

A driver tool has one or more magnets mounted or embedded within a conventional handle for providing a magnetizing and demagnetizing field, such fields being formed by permanent magnets which have energy products equal to at least $7.0\times10^6$ gauss-oersteds. Magnets may be embedded within the handle and have polar surfaces exposed to provide the desired fields where the handle may be formed with one or more openings in which the fields are generated.

23 Claims, 3 Drawing Sheets

FIG. 1
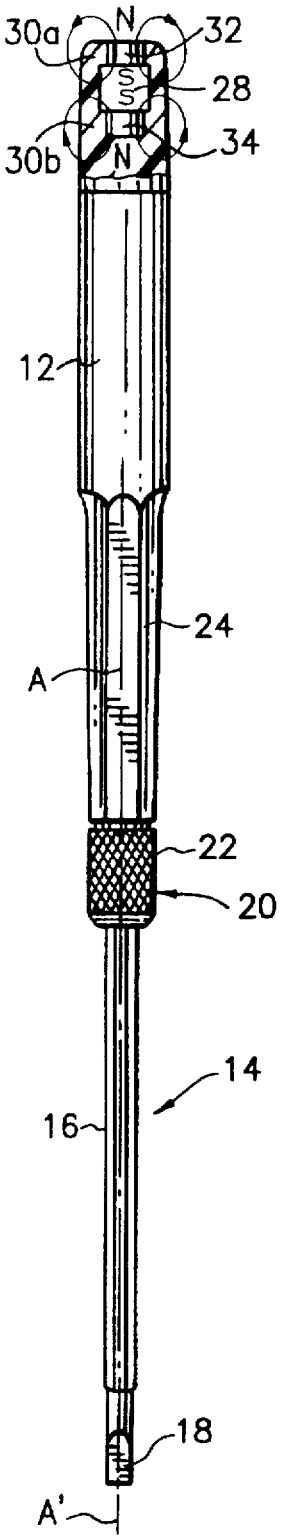
FIG. 2
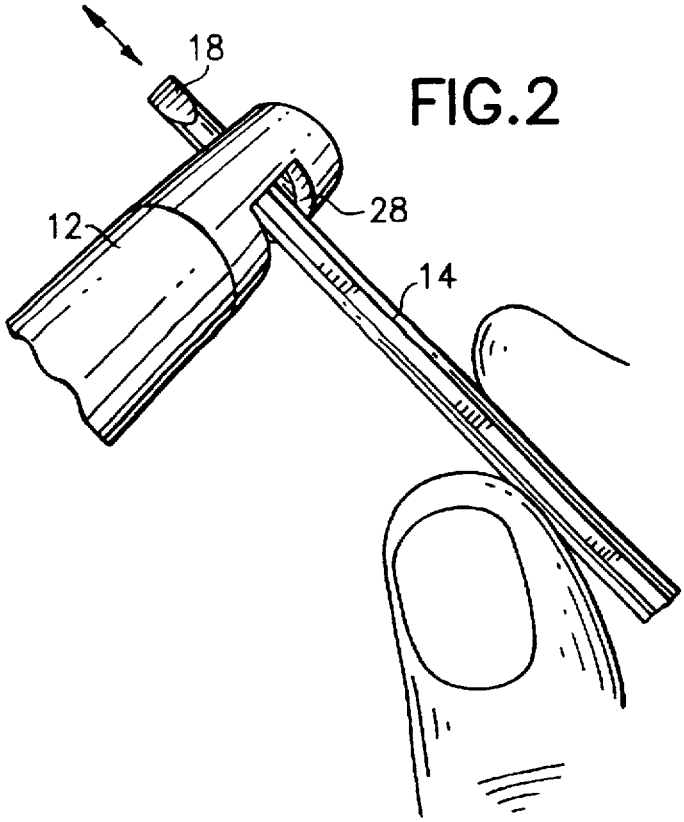
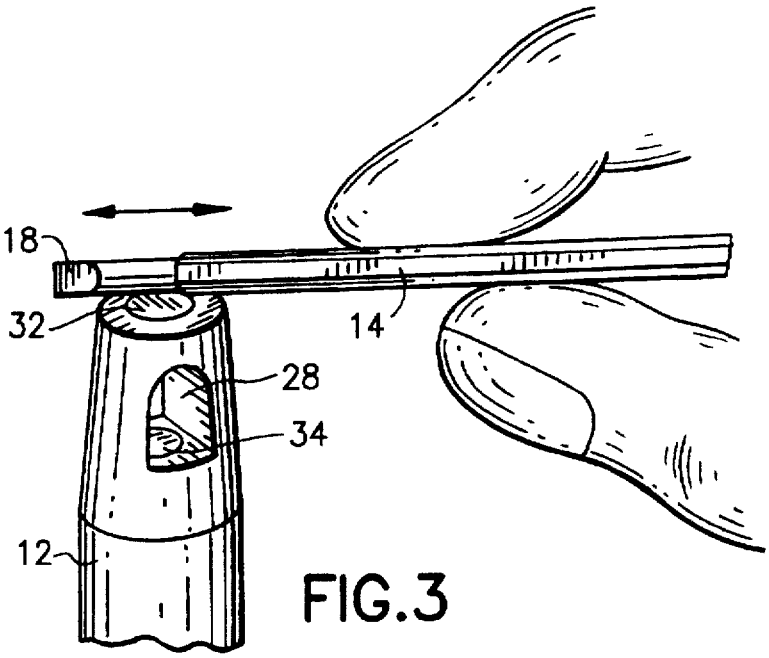
FIG. 3

FIG.8
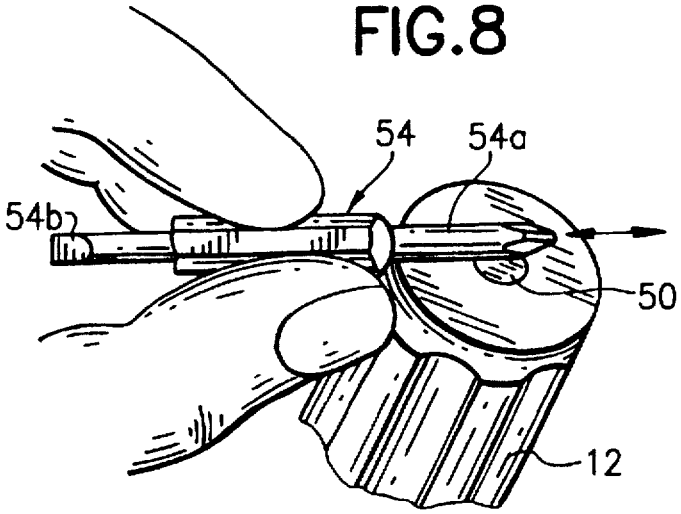
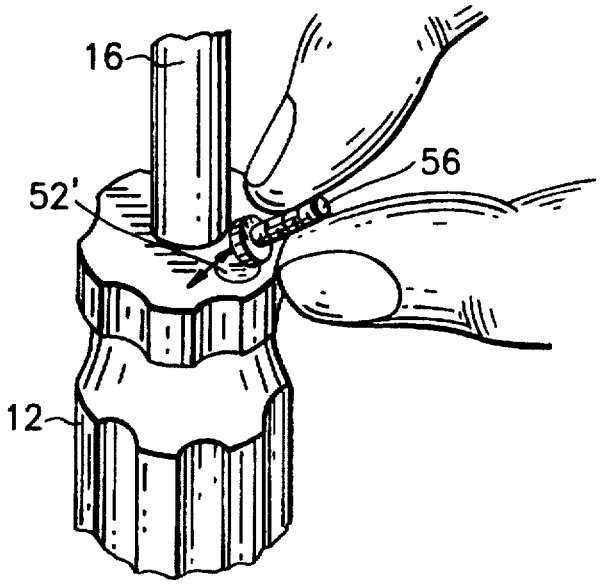
FIG.9

DRIVER TOOL WITH ENERGY MAGNETIZER/DEMAGNETIZER ON TOOL HANDLE

BACKGROUND OF THE INVENTION

1. Field of the Invention

The present invention generally relates to tools, and more specifically, to a driver tool having an elongate handle which embodies high energy magnetizer/demagnetizer permanent magnets for selectively magnetizing and/or demagnetizing a magnetizable element, such as a driver bit, fastener, and the like.

2. Description of Prior Art

It is frequently desirable to magnetize the tips of screwdriver bits, tweezers and the like to form at least temporary magnetic poles on the tool which attracts magnetizable elements. Thus, particularly with precision screwdrivers which tend to be relatively small and are used to drive relatively small screws, it is frequently advantageous to magnetize the screwdriver tips of the driver bits to maintain the screwdriver tip blade within the slot of a head of a screw or a phillips driver within the cross slots formed within the head of the screw adapted to receive the phillips screwdriver tip. By magnetizing the tip of the driver bit, and mating the tip within the associated opening in the head of the screw, the screw remains attached to the bit tip without the need to hold them together. This allows the screw to be guided through a relatively small bore or channel and moved within confined spaces. Sometimes, the magnetized tip of the driver bit is used to retrieve a metal item, such as a screw, washer, nail or the like, from an inaccessible place which would otherwise be difficult to reach with anything but a relatively thin shank of a bit driver. Of course, such attachment of a fastener to the driver bit tip also frees one hand for holding or positioning the work into which the fastener is to be driven. In some instances, rather than magnetizing the tip of the driver member bit, the fastener itself is magnetized so that, again, it is attracted to and remains attached to the driver bit tip in the same way as if the latter had been magnetized.

Conversely, there are instances when a magnetized driver bit tip is a disadvantage, because it attracts and attaches to itself various magnetizable elements or components. Under such circumstances, it may be desirable to demagnetize a driver bit tip that had been originally magnetized in order to render same magnetically neutral.

Devices for magnetizing/demagnetizing tools and small parts are well known. These normally incorporate one or more permanent magnets which create a sufficiently high magnetic field to magnetize at least a portion of a magnetizable element brought into its field. The body can be magnetized by bringing it into a magnetic field. While the magnetic properties of all materials make them respondent in some way to magnetic fields, most materials are diamagnetic or paramagnetic and show almost no response to magnetic fields. However, a magnetizable element made of a ferromagnetic material readily responds to a magnetic field and becomes, at least temporarily, magnetized when placed in such a magnetic field.

Magnetic materials are classified as soft or hard according to the ease of magnetization. Soft materials are used as devices in which change in the magnetization during operation is desirable, sometimes rapidly, as in AC generators and transformers. Hard materials are used to supply fixed fields either to act alone, as in a magnetic separator, or interact with others, as in loud speakers and instruments.

Most magnetizers/demagnetizers include commercial magnets which are formed of either Alnico or are of the ceramic type. The driver members/fasteners, on the other hand, are normally made of soft materials which are readily magnetized but more easily lose their magnetization, such as by being drawn over an iron or steel surface, subjected to a demagnetizing influence, such as heavy magnetic fields or other permanent magnetic fields, severe mechanical shock or extreme temperature variations.

One example of a magnetizer/demagnetizer is magnetizer/demagnetizer Model No. 40010, made in Germany by Wiha. This unit is in the form of a box made from plastic and forms two spaced openings defined by three spaced transverse portions. Magnets are placed within the transverse portions to provide magnetic fields in each of the two openings which are directed in substantially opposing directions. Therefore, when a magnetizable tool bit or any magnetizable component is placed within one of the openings, it becomes magnetized and when placed in the other of the openings, it becomes demagnetized. The demagnetizing window is provided progressive steps to decrease the air gap for the demagnetizing field and, therefore, provides different levels of strengths of the demagnetizing field. However, typical magnetic materials that are used with conventional magnetizers/demagnetizers include Alnico and ceramic magnets which typically have energy products equal to approximately $4.5\times10^6$ gauss-oersteds and $2.2\times10^6$ gauss-oersteds, respectively.

Since the field strength B at the pole of the magnet is a product of the unit field strength and the area, the magnet at a given plane, and since the cohesive force of the magnet (H) is the product of the unit cohesive force (are the same unit field strengths) and the length of the magnet, it follows that the energy content or BH product, is proportional to the volume of the magnet. It is for this reason that conventional magnetizers/demagnetizers have required significant volumes to provide the desired energy content suitable for magnetizing and demagnetizing parts. However, the required volumes have rendered it impossible or impractical to incorporate the magnetizers/demagnetizers on the tools in conjunction with which they are frequently used. Thus, for example, precision screwdrivers, which are relatively small and have relatively small diameter handles could not possibly incorporate sufficient magnetic material to provide desired levels of magnetic fields for magnetizing and demagnetizing parts. However, the requirement of using separate magnetizers/demagnetizers units, has rendered their use less practical. Thus, unless a user of a precision screwdriver or any driver tool obtained a separate magnetizer/demagnetizer one would not normally be available for use. Additionally, even if such magnetizer/demagnetizer were available, it would require a separate component which could be misplaced and not available when needed. Of course, there is always the risk that the magnetizer/demagnetizer could become misplaced or lost, rendering the use of the driver tool less useful.

SUMMARY OF THE INVENTION

It is an object of the present invention to provide a combination driver tool and at least one magnet for providing magnetizing field proximate to the handle to allow a driver bit or magnetizable component to be magnetized.

It is another object of the present invention to provide a combination driver tool and at least two magnets arranged on the handle for providing magnetizing and demagnetizing fields for selectively magnetizing or demagnetizing a driver bit or magnetizable element.

It is still another object of the present invention to provide such a combination driver tool as aforementioned which provides sufficiently strong magnetic fields to effectively and adequately magnetizing/demagnetizing a driver bit and/or a magnetizable component.

It is yet another object of the present invention to provide a combination driver tool as in the previous objects in which the magnetizing and demagnetizing fields are created proximate to the surface of the handle.

It is a further object of the present invention to provide a tool as in the previous objects in which the handle is provided with one or more openings within the handle in which the magnetizing and/or demagnetizing fields are formed for convenient and reliable magnetization and/or demagnetization.

In order to achieve the above objects, as well as others which will become apparent hereinafter, a combination driver tool in accordance with the present invention has an elongate handle defining a tool axis and shaped and dimentioned to be graspable within the hand of the user. A driver member, such as a screwdriver bit, phillips bit, or the like is mounted at one axial end of the handle and defines a driver axis generally co-axially aligned with the tool axis. Magnetic means is provided on said handle for providing at least a magnetizing magnetic field accessible for selective placement of a magnetizable element within the magnetizing field. Said magnetizing means is formed of a permanently magnetized material having an energy product equal to at least $7.0\times10^6$ gauss-oersteds. In accordance with the presently preferred embodiment, said magnetic means is provided with at least two magnets arranged on said handle to provide separate regions proximate to said handle one of which exhibits a magnetizing field and the other of which exhibits a demagnetizing field. However, because of the high energy products of the magnets, they are sufficiently small so as to be embedded within the relatively small diameter conventional handles used in conjunction with driver tools.

BRIEF DESCRIPTION OF THE DRAWINGS

With the above and additional objects and advantages in view, as will hereinafter appear, this invention comprises the devices, combinations and arrangements of parts hereinafter described by way of example and illustrated in the accompanying drawings of preferred embodiments in which:

FIG. 1 is a front elevational view of a combination driver tool in accordance with the present invention, in which a through opening is provided in a remote, pivotally mounted portion of the handle, with two separate magnets spaced on opposite axial sides of the openings, the poles of the magnets being so arranged to provide magnetizing and demagnetizing fields proximate to each of the exposed magnetic pole surfaces;

FIG. 2 is a fragmented perspective view of the end of the driver tool illustrated in FIG. 1, showing the screwdriver bit being moved through the opening to be magnetized;

FIG. 3 is a top perspective view of the remote portion of the handle shown in FIGS. 1 and 2, with a screwdriver bit being moved proximate to the outer magnet pole surface to demagnetize the screwdriver tip;

FIG. 8 is a fragmented perspective view of the remote axial end of the handle of FIG. 7, showing a screwdriver bit being magnetized by one of the permanent magnets mounted at the remote or free end of the handle; and FIG. 9 is similar to FIG. 8, but showing a magnetizable element, in the form of a screw, being demagnetized by the other permanent magnet shown in FIG. 7 mounted on the axial end of the handle to which the shank of the driver is connected.

DESCRIPTION OF THE PREFERRED EMBODIMENTS

Figure 4:
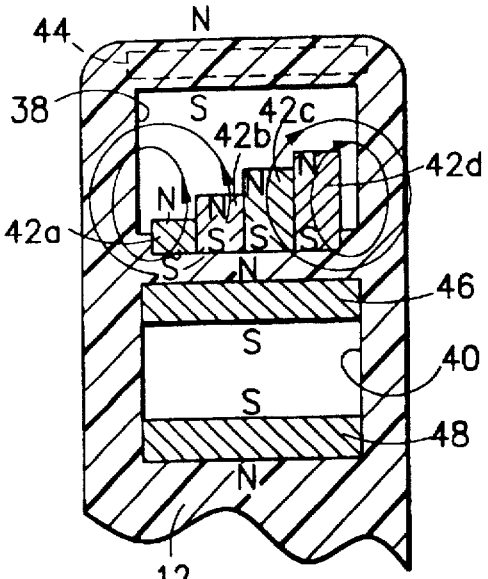
FIG. 4 is a fragmented front elevational view, in section, of another embodiment of the screwdriver handle in which two through openings are provided with magnets suitably arranged to provide a magnetizing field in one of the openings in the demagnetizing field in the other opening.

Referring now specifically to the Figures, in which identical or similar parts are designated by the same reference numerals throughout, and first referring to FIG. 1, a combination driver tool in accordance with the present invention is generally designated by the reference numeral 10. The tool 10 includes an elongate handle 12 which defines a tool axis A. An important feature of the present invention is that the handle A is shaped and dimentioned to by grippable or graspable within the hand of the user. As such, the handle 12 can assume the shape and dimensions handles of conventional driver tools, such as multi-bit screwdrivers, precision screwdrivers, etc.

A driver member 14 is mounted at one axial end 12*a* of the handle 12 and defines a driver axis A' generally co-axially aligned with the tool axes A. Although the driver member 14 may be permanently affixed to the handle 12, as shown, for example, in FIGS. 6 and 7, the driver member 14 in FIG. 1 is in the form of a screwdriver bit 16 having a screwdriver tip or blade 18 at one end, with the other end being received within an appropriate cavity (not shown) within the handle 12 and retained or secured to the handle by any known or suitable retaining means, such as a chuck 20 provided with a knurled surface 22. Although the handle 12 is generally cylindrical in shape, it may be provided with a series of flat longitudinal surfaces 24 to provide better control of the rotation of the handle about its axis.

As is typical with many precision screwdrivers, the handle 12 is provided with an axial end portion 16 which is rotatably mounted on the handle for relative rotation between the main body of the handle 12 and the axial portion 16 about the tool axis A.

An important feature of the present invention is the provision of magnetic means on the handle for providing at least a magnetizing magnetic field accessible for selective placement of a magnetizable element within the field, with the magnetic means being formed of a permanently magnetized material having an energy product sufficiently high so that the size and volume of the permanent magnet can be made sufficiently small so that it can be mounted on or embedded within conventionally sized handles, even the generally smaller handles associated and used with precision screwdrivers. Since the magnetic energy content, or BH product of a magnetic material, is proportional to the volume of the magnet, it has been determined that in order to use permanent magnets with sufficient small volumes to be mountable on driver tool handles, the magnetic properties of the permanent magnet materials must be equal to at least $7.0\times10^6$ gauss-oersteds. However, because magnetic flux lines conventionally leave the North Pole and enter the South Pole, the magnetic flux lines are always closed curves that leave for the North Pole and enter the South Pole always maintain the same direction. Therefore, magnetic flux lines generally exhibit the same directions at both Pole surfaces, with the exception that the flux lines leave from the North Pole and enter into the South Pole. The placement of a soft magnetizable material proximate to either of the polar surfaces, therefore, has the same effect on the magnetic domains of the magnetizable material and would tend to either magnetize or demagnetize the magnetizable material at each of the poles. Since both poles have the same effect on a magnetizable element, it is generally necessary to have at least two permanent magnets which are so arranged so as to provide oppositely directed magnetic fields in order to establish reverse polarizing effects on the magnetizable element. Thus, if one of the magnetic poles of one of the permanent magnets provides a magnetizing effect, the other permanent magnet is preferably so arranged so that the placement of the magnetizable element next to one of its poles will have the opposite or demagnetizing effect.

Because conventional magnetic materials that have been used in the past to provide magnetizing and demagnetizing effects have had relatively low energy products BH, they could not be embedded or mounted on conventional driver tool handles. Even when attempts to do so were made, only single bulky weak magnets could be provided which would normally serve to magnetize components. However, in accordance with the present invention, because of the high energy products of the materials contemplated by this invention, two or more magnets can now be easily mounted and/or embedded within conventional driver tool handles, even the relatively small precision screwdriver handles to provide strong magnetizing and demagnetizing fields.

In the embodiment illustrated in FIGS. 1–3, the axial portion 26 is provided with an opening 28 which extends through the axial portion 26 as shown. The magnetic means in this embodiment is arranged to provide either a magnetizing or demagnetizing field within the opening 28 and the other of the magnetizing or demagnetizing fields proximate to the axial portion outside of the opening 28. The opening 28 has an axis which is generally normal to the tool axis A and allows a driver bit or other magnetizable elements to extend through the opening as shown in FIG. 2.

The axial portion 26 has two axially spaced transverse portions 30*a* and 30*b* which define the upper and lower regions of the opening 28. Two separate permanent magnets 32, 34 are each mounted on another one of the transverse portions, the magnet 32 being mounted on the outer transverse portion 30*a*, and the magnet 34 being mounted on the inner transverse portion 30*b*. Both of the magnets 32, 24 are pill or disk shaped magnets and are arranged so that the inner pole surfaces facing into the opening 28 are the same, namely either north poles or south poles. In the specific embodiment shown, the poles facing the inside of the opening 28 are both south poles, so that the outer polar surface of the magnet 32 is a north pole. The resulting magnetic flux or magnetic field lines are such that the slow movement of a driver bit or magnetizable component proximate to the outwardly facing pole surface of the magnet 32 will provide, for example, a magnetizing effect. Conversely, once magnetized, the passage of the driver bit or magnetizable element proximate to the exposed pole surface of the magnet 34 which faces inwardly into the opening 28 will have the reverse demagnetizing effect and, therefore, will demagnetize any driver bit or magnetizable element which had been previously magnetized by the magnet 32. FIG. 2 illustrates one magnetizing or demagnetizing procedure while FIG. 3 illustrates the opposite procedure it, being clear that either one of the magnets can be used to initially magnetize while the other can be used to demagnetize. It is only important that both polarities be accessible or available. For purposes of consistency and predictability, it may be desirable to denominate one of the magnets as producing a magnetizing field and the other demagnetizing field so that the user can consistently predict which effect the two magnets will have on the driver bit or magnetizable element. Suitable markings or instructions may be provided for this purpose.

Referring to FIG. 4, the handle 12 has a fixed axial end portion 36, provided with two axially spaced openings 38, 40 extending through the axial portion 36. In this embodiment, the magnetic means is arranged to provide a magnetizing or demagnetizing field within one of the openings 36, 38 while the opposite field is provided within the other of the openings. Although the openings may be variably arranged relative to each other on the handle 12, the openings in the embodiment illustrated in FIG. 4 each have an axis which is generally normal to the tool axis and the axes of the openings are generally parallel to each other thereby facing the same direction.

In order to provide oppositely directed magnetic fields within each of the openings 36, 38, various magnetic arrangements of permanent magnets may be used. This effect may be provided with two permanent magnets, as with the arrangements shown in FIGS. 1–3. However, in FIG. 4, an arrangement is shown in which three permanent magnets are used and an optional fourth magnet may also be used to linearize the magnetic fields. Thus, the opening 38 is provided with a series of progressively larger magnets along the transverse direction of the opening 38. The progressive steps may be provided by a single suitably shaped magnet or a series of bar magnets 42*a*–42*d* of different lengths as illustrated. Although the bar magnets 42*a*–42*d* have progressively greater lengths, all of the magnetic poles are aligned, so that all of the north poles face inwardly into the opening 38. Where an optional fourth magnet is provided, the optional magnet 44 is selected so that its south pole faces inwardly into the opening 38 so as to linearize the magnetic field within the opening 38. Clearly, since each of the magnets 42*a*–42*d* are progressively larger, the larger magnets with the greater volumes will have greater energy products and will provide strong magnetic fields. The user can, then, place the driver bit or magnetizable element proximate to the respective step which provides the level or degree of magnetization or demagnetization required. The magnets 46, 48, defining the opening 40, are arranged so that opposite poles face each other across the opening, this likewise serving to linearize the magnetic field within that opening. The opening 40 can be used, for example, to magnetize driver bits or magnetizable elements, while the progressive steps defined by the magnets 42*a*–42*d* provide the necessary level of demagnetization to demagnetize the elements.

Figure 5:
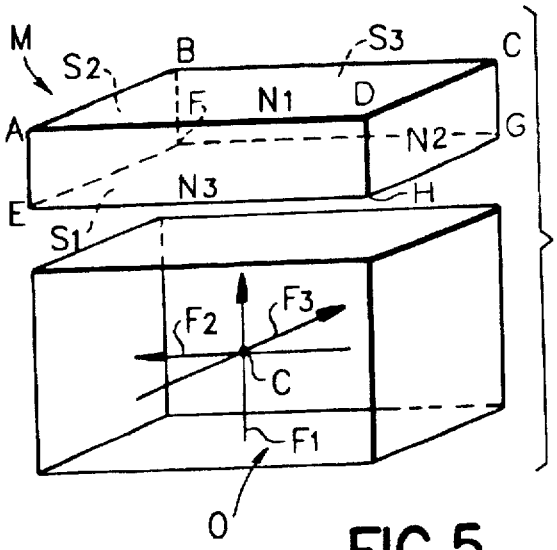
FIG. 5 is a diagrammatic view of a bar magnet, showing different possible polarizations of opposing faces and associated directions of magnetic fields within an opening proximate to the magnet to variously magnetize a magnetizable part passed through the opening of the type shown in FIG. 1.

In FIG. 1, as indicated, the pole surfaces which face inwardly into the opening 28 and face each other are of the same polarity. In FIG. 1, both of the magnets 32, 34 have their south polar surfaces facing each other. Such an arrangement of the polar faces or surfaces produces magnetic field lines which have components which are substantially parallel to the tool axis A within the opening 28. As will be clear to those skilled in the art, the magnets can be polarized in different ways to change the relative positions of the polar surfaces and this would correspondingly modify the directions of the magnetic field lines within the opening through which the magnetizable component or part is passed. Referring to FIG. 5, a rectangular bar magnet M is illustrated proximate to an opening O of the type illustrated in FIG. 1 within a handle. Each of the corners of the bar magnet has been assigned a letter designation A–G to facilitate the description that follows. The opening O has an interior point C which, for purposes of the description, may be a point which is generally centrally located within the opening O. The bar magnet M has three pairs of opposing faces or surfaces, each pair of which can be magnetized to define a north and south pole. By selecting the manner in which the bar magnet is magnetized and, therefore, which pair of parallel surfaces define the pole faces, different magnetic field lines having corresponding orientations or directions will be available at point C within the opening O. Thus, if the upper and lower surfaces ABCD and EFGH are magnetized to define north and south poles, respectively, such a magnet would produce magnetic filed lines which have generally vertical components $F_1$ through point C in the opening O. If, however, the magnet M were to be magnetized so that the north and south polar surfaces are surfaces CDGH and ABEF, respectively, the magnetic field within the opening O would have magnetic field line components $F_2$ that are generally transverse to the opening in a direction substantially perpendicular to the tool axis A. Finally, if the bar magnet M was magnetized to arrange the north and south magnetic pole surfaces at ADEH and BCFG, respectively, the magnetic field lines within the opening O would have components $F_3$ at point C which extend or pass through the opening O at point C. Clearly, each of the arrangements for the pole faces will serve to magnetize a magnetizable part or member which is passed through the opening O. If an elongate magnetizable member, such as a bit driver, were to be passed through the opening O, as suggested in FIG. 2, the magnetic field lines $F_1$ and $F_2$ would magnetize the part along a transverse direction of the longitudinal length of the part so that, for example, if the part had a circular cross section the part would be magnetized to produce north and south poles at diametrically opposite ends of the part. On the other hand, an orientation of the magnetic poles which produces components of the type represented by $F_3$ would magnetize the elongate member along its longitudinal length to produce a north or south pole at the tip of the member. Clearly, each of these magnetization arrangements can be used, with different degrees of advantage. The most desirable arrangement, for most applications, would be the provision of the magnetic pole faces at surfaces ADEH and BCFG to produce magnetic field components $F_3$ which generally extend through the opening generally co-extensively with the direction of the longitudinal part that is passed through the opening O. The various polarization options of the magnets can be used with the embodiment of FIG. 1, as well as with the other embodiments described below. Where two magnets are used on a tool handle, the polarizations of the two magnets are preferably coordinated to provide optimum results, particularly if the magnets are in close proximity to each other in such a manner that the fields may interact with each other.

Figure 6:
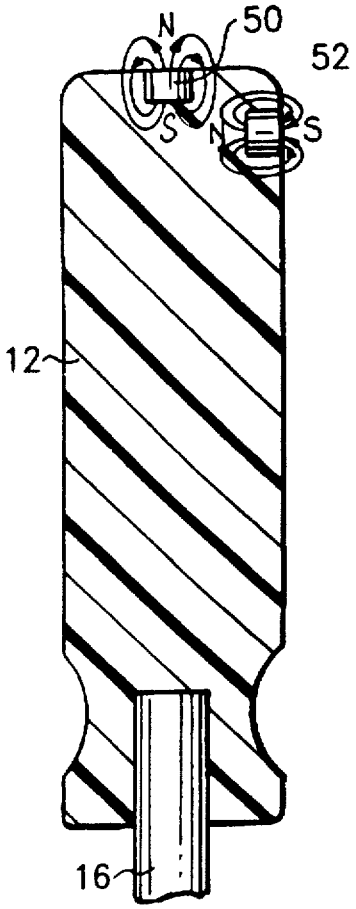
FIG. 6 is a fragmented cross sectional view of another embodiment of the driver tool, in which the driver tool bit shank is mounted at one axial end of the handle and one permanent magnet is arranged at the other axial end, while a second permanent magnet is mounted between the two axial ends of the handle.
Figure 7:
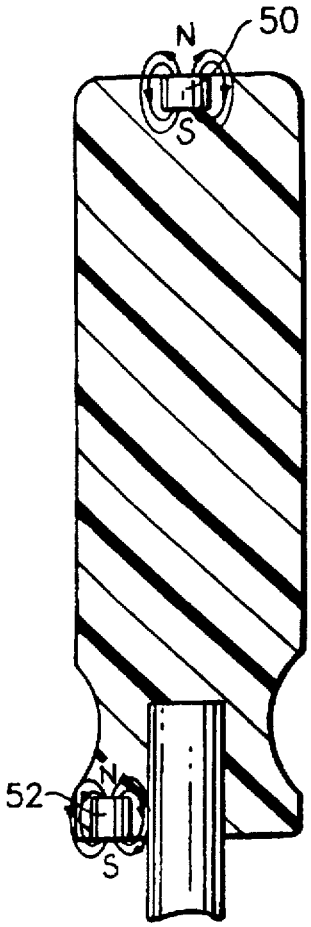
FIG. 7 is similar to FIG. 6, but with the two permanent magnets mounted at opposite axial ends of the handle.

Simple yet effective constructions are illustrated in FIGS. 6 and 7 in which pill or disk magnets are embedded within conventional driver tool handles. One but preferably two such magnets are embedded in the tool handles at points sufficiently remote from each other so to avoid undue interaction of the magnetic fields with each other. With such construction, one of the magnets is mounted to expose its north pole, while the other of the magnets exposes its south pole. This provides appropriately directed magnetic field which can, as with the previous arrangements, provide magnetization and demagnetization effects. In FIG. 6, the permanent magnet 50 is mounted at the remote end opposite to the axial end on which the driver bit shank 16 is mounted, while the magnet 52 is mounted on the side of the handle at a point between the two axial remote ends. Which magnet exposes the north pole and the south pole is irrelevant since, as indicated, either pole may serve to magnetize or demagnetize a magnetizable element. In FIG. 6, the magnet 50 exposes its north pole while the magnet 52 exposes its south pole.

In FIG. 7, the magnet 52 of FIG. 6 has been moved to the other axial end of the handle 12, at 52'. However, notwithstanding its change in location the magnet 52' continues to expose its south pole to provide a magnetizing effect which is opposite to that provided by the magnet 50.

In FIG. 8, a magnetizable driver element 54 having a phillips driver end **54*a* and a screwdriver flat blade end 54*b* is shown as being magnetized by the magnet 50 of FIG. 7. This is done by slowly passing the end 54*a* proximate to the exposed pole surface of the magnet 50 so as to place it within the magnetic field emanating from the magnet. The magnet 52' can be used to demagnetize driver bits or other magnetizable elements which have been magnetized by the magnet 50, as suggested in FIG. 9, where a fastener in the form of a screw 56 is being demagnetized by the magnet 52'**.

As is clear from the above description, numerous arrangements of magnets may be provided to provide enhanced magnetizing and demagnetizing fields on conventional handles of driver tools. While this is made possible by the use of permanent magnets which have energy products BH equal to at least $7.0\times10^6$ gauss-oersteds, it is preferred that the magnetic materials used be formed of magnetic materials which have energy products equal to at least approximately $9\times10^6$ gauss-oersteds. Such levels of energy products are obtainable with the classes of materials generally known as neodymium iron boron and cobalt vare earth permanent magnets. Such materials are available, for example, from Polymag, Inc. of Bellport, N.Y. and sold under style designations PM70, Poly 10, NDFB30H, NDFB35, NDFB27; and from Hitachi Magnetics Corporation, Division of Hitachi Metals International, Ltd. under the style designations Hicorex 90A, 90B, 96A, 96B, 99A and 99B.

While this invention has been described in detail with particular reference to a preferred embodiment thereof, it will be understood that variations and modification will be effected within the spirit and scope of the invention as described herein and as defined in the appended claims.

I claim:

1. A driver tool comprising an elongate handle defining a tool axis and shaped and dimensioned to be graspable within the hand of a user; a driver member mounted at one axial end of said handle and defining a driver axis generally co-axially aligned with said tool axis; and magnet means formed of a permanently magnetized material on said handle for providing at least a magnetizing magnetic field accessible for selective placement of a magnetizable element within said field, wherein said magnet means is provided with at least two magnets arranged on said handle to provide separate regions one of which exhibits a magnetizing field and the other of which exhibits a demagnetizing field.

2. A driver tool comprising an elongate handle defining a tool axis and shaped and dimensioned to be graspable within the hand of a user; a driver member mounted at one axial end of said handle and defining a driver axis generally co-axially aligned with said tool axis; and magnet means formed of a permanently magnetized material on said handle for providing at least a magnetizing magnetic field accessible for selective placement of a magnetizable element within said field, wherein said magnetic means comprises two separate permanent magnets spaced from each other on said handle and expose opposite magnetic poles proximate to said handle.

3. A driver tool as defined in claim 2, wherein the energy product of the magnetized material is equal to at least $7.0\times10^6$ gauss-oersteds.

4. A driver tool as defined in claim 2, wherein said two permanent magnets are mounted at opposite axial ends of said handle.

5. A driver tool as defined in claim 2, wherein one of said permanent magnets is mounted at the other axial end of said handle and the other of said permanent magnets is mounted on said handle at a point intermediate said opposing axial ends.

6. A driver tool as defined in claim 2, wherein said permanent magnets are embedded within said handle each exposing only one polar surface.

7. A driver tool as defined in claim 2, wherein said permanent magnets are pill magnets.

8. A driver tool as defined in claim 2, wherein said magnet means is formed of neodymium iron boron permanent magnetic material.

9. A driver tool as defined in claim 2, wherein said magnet means is formed of cobalt rare earth permanent magnetic material.

10. A driver tool as defined in claim 2, wherein the driver tool is a precision screwdriver including means for removably securing said driver member to said handle.

11. A driver tool as defined in claim 2, wherein the energy product of the magnetized material is equal to at least approximately $9\times10^6$ gauss-oersteds.

12. A driver tool as defined in claim 1, wherein said handle has an axial portion, remote from said one axial end, provided with a transverse opening extending through said axial portion; said magnetic means being arranged to provide one of said magnetizing and demagnetizing fields within said opening and the other of said magnetizing and demagnetizing fields proximate to said axial portion outside said opening.

13. A driver tool as defined in claim 12, wherein said opening has an axis which is generally normal to said tool axis.

14. A driver tool as defined in claim 12, wherein said axial portion is rotatably mounted on said handle for rotation about said tool axis.

15. A driver tool as defined in claim 12, wherein said axial portion has two axially spaced transverse portions defining said opening, said magnetic means comprising two separate permanent magnets each mounted on another of said transverse portions, the magnetic poles bounding said opening and facing each other being of the same polarity.

16. A driver tool as defined in claim 1, wherein said handle has an axial portion, remote from said one axial end, provided with two axially spaced openings extending through said axial portion, said magnetic means being arranged to provide one of said magnetizing and demagnetizing fields within one of said opening and the other said magnetizing and demagnetizing fields within the other of said openings.

17. A driver tool as defined in claim 16, wherein said openings each have an axis which is generally normal to said tool axis.

18. A driver tool as defined in claim 17, wherein said axes of said openings are generally parallel to each other.

19. A driver tool as defined in claim 16, wherein said magnetic means comprises four permanent magnets two of which are associated with each of said openings for forming oppositely directed flux lines within each of said openings.

20. A driver tool as defined in claim 16, wherein at least one of said openings are provided with progressive steps along a direction normal to said tool axis to provide varying air gaps and levels of demagnetizing fields.

21. A driver tool as defined in claim 12, wherein said magnetic means is polarized to provide magnetic field lines within said opening which are substantially parallel to said tool axis.

22. A driver tool as defined in claim 12, wherein said magnetic means is polarized to provide magnetic field lines which extend through said opening along a direction substantially normal to said tool axis.

23. A driver tool as defined in claim 12, wherein said magnetic means is polarized to provide magnetic field lines which extend across said opening substantially normal to said tool axis.

* * * * *